US005375072A

United States Patent [19]

Cohen

[11] Patent Number: 5,375,072

[45] Date of Patent: Dec. 20, 1994

[54] MICROCOMPUTER DEVICE WITH TRIANGULATION RANGEFINDER FOR FIREARM TRAJECTORY COMPENSATION

[76] Inventor: Stephen E. Cohen, 1521 Brandywyn La., Buffalo Grove, Ill. 60089

[21] Appl. No.: 857,623

[22] Filed: Mar. 25, 1992

[51] Int. Cl.[5] ..... F41G 1/00; G06F 15/58

[52] U.S. Cl. ..... 364/561; 235/414; 235/417; 89/41.17

[58] Field of Search ..... 364/516, 561, 514, 550; 89/41.01, 41.03, 41.17, 41.19; 235/404, 407, 414, 417

[56] References Cited

U.S. PATENT DOCUMENTS

| | | | |
|---|---|---|---|
| 2,004,089 | 6/1935 | Kuhn | 33/50 |
| 3,737,232 | 6/1973 | Milburn | 33/245 |
| 4,397,107 | 8/1983 | Holden | 42/101 |
| 4,531,052 | 7/1985 | Moore | 235/404 |
| 4,561,204 | 12/1985 | Binion | 42/101 |
| 4,754,268 | 6/1988 | Mori | 340/710 |
| 4,777,352 | 10/1988 | Moore | 235/404 |
| 4,787,739 | 11/1988 | Gregory | 356/4 |
| 4,965,439 | 10/1990 | Moore | 235/404 |

FOREIGN PATENT DOCUMENTS 0009520 of 1889 United Kingdom .

*Primary Examiner*—Jack B. Harvey
*Assistant Examiner*—Edward Pipala

[57] ABSTRACT

A computerized instrument for displacing the aiming mark of a rifle or other small arm to compensate for ballistic trajectory, comprising a digital microcomputer, a triangulation rangefinder range data inputting system, a system for inputting data for a plurality of small arms ammo (9), other data inputting systems, an appropriate program including a small arms ballistic trajectory program, and an electric aiming mark displacement system with an aiming mark displacement data outputting receiver for acquiring cordless data transmission from a physically separate aiming mark displacement data outputting transmitter. The transmitter is physically integrated with a device comprising all subsystems of the instrument other than the cordless transmission slaved electric aiming mark displacement system with cordless transmission receiver. The small arms aiming mark displacement system and receiver may be in a telescopic sight or in an adjustable telescopic sight mount.

3 Claims, 5 Drawing Sheets

MICROCOMPUTER DEVICE WITH TRIANGULATION RANGEFINDER FOR FIREARM TRAJECTORY COMPENSATION

BACKGROUND OF THE INVENTION

The invention relates to computerized devices including rangefinders for ballistic trajectory compensation of small arms.

U.S. Pat. No. 4,531,052, issued in 1985 to Moore, involves a computerized rifle telescopic sight with a stadia rangefinder for ballistic trajectory compensation. The rangefinder is a dynamic stadia rangefinder, with the rangefinding bracket lines being produced by solid state imaging of LCD or LED devices, the stadia brackets being optically superimposed on one of the focal planes of the scope. The size of the target is inputted into the computer, the current scope magnification (if it is a variable power scope) is inputted, and the hunter has merely to operate the controls to adjust the brackets to precisely frame the top and bottom of the segment (usually shoulders to chest) of the target animal that is the stadia reference, and the computer will output the range as per well known stadia rangefinding formulae, Moore's device utilizes a small arms ballistic trajectory program relying on such familiar methods of computation as the Siacci method, together with data inputting buttons, and data inputting solid state display. The hunter inputs ballistic data specific to his rifle and the ammunition he is using, such as bullet weight, muzzle velocity, ballistic coefficient; sighting adjustment data, such as zero range and height of scope; atmospheric data and angle of elevation. This inputted data together with the stadia rangefinder determined range to the target is utilized by the computer in applying the ballistic trajectory program to determine what adjustments have to be made to the aiming mark (usually the center of the crosshairs reticle of the scope) to compensate for range and other parameters involved so that the hunter can aim the firearm precisely where he wants the bullet to hit the target and have it impact the target at that point. The computer moves one of the bracket lines to the appropriate point on the verticle line of the crosshair, so that the intersection of that bracket line and the verticle line of the crosshair constitutes the correctly compensated aiming point. The hunter, using this compensated aiming point supplied by the computer, is now in a position to aim "dead on" and fire, the uncertainties of guesswork and holdover having been eliminated. In U.S. Pat. No. 4,777,352, issued to Moore in 1988, he discloses a variation of his device in which in place of the solid state imaged brackets, a computer controlled cam moves a physical reticle containing a horizontal bracket line with the second stationary bracket line being the horizontal line of the crosshairs reticle. In U.S. Pat. No. 4,965,439, issued to Moore in 1990, he discloses a refinement in which a computer controlled screw displaces the spring biased erector tube containing the scope crosshairs reticle in the rear focal plane of the scope so that its horizontal line moves in relation to a second reticle in the front focal plane in front of the erector tube which contains the other stadia bracket line which remains stationary. The use of the digital computer together with the small arms ballistic trajectory program and broad data inputting capability make Moore's device a major advance over the prior art of mechanical bullet drop compensation/stadia rangefinding rifle scopes, deliniated in some detail in the "Description of the Prior Art" section in Moore's patents, in which only a small number of ballistic trajectories, not modifiable for unique ammo, rifle, sighting in, atmospheric, etc., conditions can be accomodated with interchangeable bullet drop compensation elevation knobs (or overlays for the elevation knobs) each calibrated to a particular ballistic trajectory.

U.S. Pat. No. 4,561,204, issued to Binion in 1985, discloses a computerized rifle telescopic sight with a stadia rangefinder for ballistic trajectory compensation. In the Binion invention, the computerized solid state reticle display, showing the stadia brackets, computer controlled aiming mark, and range and atmospheric data, is offset laterally by a connecting arm from the scope to which it is connected, and the offset arm is so adjusted that the shooter looks through the scope with one eye, while viewing the computer controlled reticle display with the other eye. Superimposition of the reticle display on the scope field of view is by the combining of the two images in the hunters optical central nervous system, rather than by optical superimposition within the scope. Binion discloses the use of sensors for wind, temperature, humidity, and muzzle angle of elevation. In addition to the illustrated stadia rangefinder, Binion suggests that his device could be designed without a rangefinder, with simply the means to input range data to be determined by a separate rangefinder. Although Binion illustrates his device with knobs for adjusting the aiming mark vertically and horizontally for sighting in the rifle, his invention, unlike Moore's, does not include a data inputting button console for inputting ammo, rifle, sighting in, or any other data.

Binion's device has many weaknesses, in comparison to Moore's. First, the absence of plurality of ammo, rifle, and sighting in data inputting capability severely restricts the usefullness of the device for civilian purposes, and in effect dictates that the costly expedient of producing the device in different models programmed for particular rifle-ammo combinations be utilized. A second very serious defect, which renders the device worse than useless in the field is that the two eye method of combining the images of the scope field of view and the reticle display in the hunter's optical central nervous system, produces an unstable superimposition in which the perceived image fluctuates from the combination of the two images to the image of the reticle display to the scope field of view, back to the combined image, etc. This kind of unstable image results from "tricking" the optical nervous system, by having the separate eyes seeing completely different images, rather than looking at the same image. A third serious defect is that the shooter's field of view is restricted to that of the telescopic sight. At high scope magnification, the scope field of view can be very narrow. If the animal moves, the hunter will loose sight of him. With the Moore device, or with a standard rifle scope, the second eye of the hunter not looking through the scope is available for seeing a broad, unmagnified field of view. Another serious problem with the Binion device is that its laterally offset position from the scope renders it very vulnerable to being knocked out of precise alignment with the scope in normal field use, which would result in gross inaccuracy in the use of the device, until it was realigned with the scope. The two eye reticle image superimposition system, which is the keystone of the Binion device, is very impractical and undesirable.

U.S. Pat. No. 4,787,739, issued to Gregory in 1988, discloses, inter alia, a computerized rifle scope with a stadia rangefinder for ballistic trajectory compensation, in which the central feature of the Gregory invention is that the computer generates a solid state display of an actual outline of the target or some part of the target rather than mere bracket lines. Both static and dynamic stadia rangefinders of this unusual type are disclosed. Data inputting of specific: ammo, rifle, sighting in, atmospheric, etc. data is not included in the Gregory patent. Gregory's device is primarily a very innovative system for stadia rangefinding as part of a computerized, artificial "vision" system, and only secondarily a computerized rifle scope with a stadia rangefinder for aiming mark adjustment as per ballistic trajectory at determined range. For this secondary purpose, aside from its grossly inadequate data inputting for ballistic trajectory compensation, it has several serious weaknesses. In the first place, for the computer to produce accurate full target (or part of target, i.e., the head) outlines, very complex, memory hungry programing will be required as well as very expensive electronic imaging hardware to provide a very fine, high resolution image of the complex outline. This will be very costly, and will leave little data processing capability in a very small computer included in a small arms scope for ballistic trajectory programming, etc. Second, the computer generated target outline will be worse than useless, unless the target profile that the hunter sees is that outlined. Gregory illustrates the side profile of a deer in various examples from his drawings. What if the deer is facing forward or rearward or at an angle?. Finally, the complex target outline, even in the dynamic stadia rangefinder embodiment, where only a single outline is shown at one time, produces intolerable, distracting clutter in the hunter's field of view.

The stadia rangefinding systems used to input target range in the Moore, Binion, and Gregory computerized small arm scopes have the same inherent flaw as the stadia rangefinding systems used in the prior art of mechanical bullet drop compensation/stadia rangefinding small arms scopes when applied to living creatures, namely, that living creatures are not of a fixed size, but to the contrary, show wide size variation. Moore himself in U.S. Pat. No. 4,777,352 (col. 12, lines 17–37) states that the shoulders to chest measurement of deer can vary from an alleged norm of 18 inches to 22 inches because of good forage. Presumably, if forage were poor, the reverse would be true, and the measurement might be 14 inches. This, of course, constitutes a very wide stadia reference size variation, which would produce gross inaccuracy in the rangefinding. Moore, however, is satisfied that visits to taxidermists and hunting supply stores will result in correct stadia reference size inputting. Biological facts point to a different conclusion. Size variations among adult creatures of a given sex of any species, mule deer, grizzly bears, or human beings, are caused by many factors in addition to forage, including, inter alia, genetics, condition of the mother following conception, condition of the mother during the nursing period,disease history of the individual. It is these factors, among others, which produce such wide size variation among a given species population during a season of any given forage conditions. These are rudimentary biological facts. Indeed, it is interesting to note that even the major manufacturers of rifle scopes containing a stadia rangefinding feature are in disagreement over the size norm for the stadia reference for given animals. Thus, Leupold & Stevens takes the position that shoulders to chest for a deer is 16 inches, Bushnell states in its brochure that it is 18 inches, while Tasco in its brochure argues that for a white tail deer it is 18 inches but for a mule deer it is 22 inches. Just as it is common knowledge that adult human males do not come in a fixed size, but instead come in a wide variety of sizes, so it also is for a given sex and age with any other animal species.

Thus, it is seen that the utilization of stadia reference size norms for animals is a striking example of the microcomputer acronym, "gigo", which stands for "garbage in, garbage out", and which means that if flawed data is inputted into the computer, the outputted data is certain to be flawed. Exactly how flawed the outputted data (aiming mark adjustment to achieve ballistic trajectory compensation at the determined target range) is likely to be will now be examined. Three very popular rifle calibers used for deer and deer size game are considered, the 7 mm Remington Magnum, the 270 Winchester, and the 30—30 Winchester. Federal Cartridge Co. factory leaded ammunition is utilized, specifically the 7 mm Remington Magnum 165 gr spitzer boat tail, the 270 Winchester 150 gr spitzer boat tail, and the 30—30 Winchester 170 gr Nosier round nose. Published Federal firing table data is utilized. Analysis has been carried out with the Barnes Ballistics program. Assuming that the stadia reference (shoulders to chest) norm for deer is 18 inches, and a size variation of 16–20 inches is allowed, the rangefinding error margin is ±11%, which for purposes of this analysis will be dealt with as ±10%. Assuming that the size variation is 14–22 inches, the rangefinding error margin is 22%, which for purposes of this analysis will be dealt with as 20%.

For a deer size target, the lethal zone (also called the "vital zone" and the "point blank zone") is considered to be ±5 inches; i.e., if the bullet point of impact deviates no more than that amount from the point of aim, a kill is likely; if the bullet point of impact deviates more than that amount from the point of aim, a miss is likely. Thus it is clear that for a deer size target, the stadia rangefinder extends lethal accuracy no further than that range at which a given rangefinding error (resulting from actual target size deviation from the inputted stadia rangefinding target size norm) translates into bullet impact deviation from point of aim no greater than ±5 inches. For the Federal 7 mm Rem Magnum ammo, a 10% rangefinding error limits the range of lethal accuracy to approximately 350 yards. With a 20% rangefinding error, lethal accuracy is limited to approximately 265 yards. For the Federal 270 Winchester ammo, a 10% rangefinding error limits the range of lethal accuracy to approximately 340 yards, while a 20% rangefinding error limits lethal accuracy to about 250 yards. For the Federal 30—30 Winchester ammo, a 10% rangefinding error limits lethal accuracy to 250 yards, while a 20% rangefinding error limits lethal accuracy to about 200 yards. Even with the optimistic 10% rangefinding error, with each of the three types of ammo, the range of lethal accuracy achieved with the stadia rangefinder is no more than maximum point blank range. Maximum point blank range for the Federal 7 mm Remington Magnum ammo is 366 yards with optimum zero range of 309 yards; maximum point blank range for the Federal 270 Winchester ammo is 346 yards for an optimum zero range of 293 yards; maximum point blank range for the Federal 30—30 Winchester ammo is 250 yards for an optimum zero range of 214 yards. With a more realistic 20% rangefinding error, maximum point blank range is substantially greater than the range of lethal accuracy provided by the rangefinder.

The computerized devices developed by Moore, Binion, and Gregory, however great the data processing capability of the computer, however powerful the ballistic trajectory program, however great the scope and detail of data inputting capability, are incapable of providing greater accuracy than the stadia rangefinding systems that they use, and this is their fatal weakness. Even with an unrealistically optimistic assumption of only a 10% stadia rangefinding error, the computerized devices of Moore, Binion and Gregory are worthless and a waste of money for the hunter because the hunter can utilize the cheap, simple, and reliable expedient of sighting in his rifle to maximum point blank range to achieve the same range of lethal accuracy. If a more realistic 20% stadia rangefinding error is assumed as a result of actual target size deviation from the inputted stadia rangefinding target size norm, the hunter finds his range of lethal accuracy degraded substantially by the computerized devices from maximum point blank range. The stadia rangefinder, which is an integral part of Moore's and Gregory's devices, and which is the illustrated rangefinder with Binion's device (although Binion does allow for the use of an external rangefinder with range data inputting capability for his device), renders these devices worthless shams in terms of the inability to achieve any increase of lethal accuracy range over maximum point blank range, and prevents the microcomputer, with broad data inputting capability, and with powerful small arms ballistic trajectory compensation programs such as Barnes Ballistics, from achieving the theoretical potential of substantial extension of lethal accuracy range far beyond point blank range.

There are only two alternative rangefinder systems to the stadia rangefinder for small arms, the laser rangefinder and the triangulation rangefinder. The laser rangefinder is widely used in ordnance fire control systems. However, the laser rangefinder's size, weight, and cost alone preclude it from consideration for small arms ballistic trajectory compensation. In addition, a sufficiently powerful laser for rangefinding out to 1,000 yards and beyond, presents dangers (i,e., to the eyes), and is illegal for civilian use. It is the triangulation rangefinder which provides the needed accuracy in a sufficiently small and cheap package, The triangulation rangefinder is an optical instrument for measuring distance to a target comprising two windows, each with a reflector, spaced apart, through which light from the target enters. The distance between the centers of the windows is the base length of the triangle, and the rangefinder operates as an angle measuring degree for solving the right triangle comprising the triangle base and the lines from the two windows to the target. Such rangefinders have been in use for more than a century, and those knowledgeable in the prior art of triangulation rangefinders will be familiar with a variety of types, including the coincidence (single eye view) type, with merger of images, split images, superimposed images, use of mirrors (with one of the mirrors being a beam splitter) or prisms as reflectors, and also stereoscopic types. In the simple coincidence type, there are two reflecting elements, one of which is displaced to form the angle with the target to be measured, or alternatively, the two reflecting elements may both be fixed in position and a displacement prism may be utilized to displace the image of one to form the angle with the target. Such rangefinders, and the mathematical formulae utilized for solving the triangles are described in some detail in D. F. Horne, *Optical Instruments and their Applications,* 1980, and in "Rangefinder (optics)" by Edward K. Kaprelian on pp. 186–188 of vol. 15 of the *McGraw Hill Science Encyclopedia,* 6th ed., 1987.

The seminal triangulation rangefinder patent is British Pat. No. 9520, issued to Archibald Bart and William Stroud in 1889. The triangulation rangefinder was invented by Barr & Stroud to satisfy an advertisement by the British War Office for an accurate rangefinder for use by infantry. Their coincidence triangulation rangefinder is as described in the previous paragraph, Bart & Stroud also disclose in the patent the use of a swivel clip to attach the rangefinder to a rifle, allowing it to be swiveled perpendicular to the rifle for use, and above and parallel to the rifle barrel when not in use. The proposed attachement to the rifle is very cumbersome, bulky, gets in the way of the rifle sight (and is thus impractical), and will subject the sensitive optical instrument to the severe shocks of recoil which will throw off the rangefinder's calibration. There is no bullet drop compensation feature, and the user would be manually adjusting the rear sight of the rifle to conform to the deterimed range. This is very slow, cumbersome and crude integration with a firearm, and furthermore, its data output capability is limited to range.

U.S. Pat. No. 3,737,232, issued to Raymond Milburn in 1973, is for a triangulation rangefinder for small arms comprising a telescopic sight and a laterally connected "range telescope" In this triangulation rangefinder, the shooter views through one eye the reticle in the telescopic sight and through the other eye the reticle in the range telescope. A rotatable wheel moves a lense assembly in the range telescope, which optically displaces the image of the reticle in that telescope. The device is so calibrated that when the marksman has moved the two crosshairs reticles to coincidence, the range to target can be read on a scale on the rotatable wheel.

The Milburn triangulation rangefinder has numerous weaknesses. First, it is a very cumbersome device which would consume precious time in utilization, in which time the target might wander off. Second, both eyes of the shooter are utilized, which means that the shooter's field of view is limited to the narrow field of view of the telescopic sight, which could be most unfortunate if the animal should quickly move out of the field of view of the scope. Thirdly, the device would cause the rifle to be very bulky and cumbersome to carry and manipulate in the field. But the most serious flaw relates to the accuracy of the device itself. The accuracy of a triangulation rangefinder is a function of the magnification of the target images and the length of the triangulation base. In this case, the base is the distance between the centers of the two scopes. The rifle, with this device attached, would be totally unwieldy, and extremely difficult to carry or manipulate in the field, unless this lateral distance from the scope to the range telescope is kept as short as possible. Even a 6 inch lateral extension would be very cumbersome, and render the rifle very difficult to carry or use in the field. But, even with high magnification, i.e., 18 power, a triangle base of more than twice that length (i.e., at least one foot) would be required to increase the range of lethal accuracy to approximately twice maximum point blank range. The inherent flaw, which renders this device impractical and unusable for its stated purpose-accurate rangefinding for a firearm—is that there is a direct conflict between one of the requirements of accurate triangulation rangefinding (a long triangulation base) and one of the requirements of easy field carrying and fast and easy field manipulation (a compact device with negligible lateral offset) of the weapon.

Ranging, an unincorporated division of Crossman Corporation, manufactures the Rangematic 1000 triangulation rangefinder, which, with its five interchangeable Distran representative ballistic trajectory scales, increases the range of lethal accuracy beyond maximum point blank range for some types of rifle ammo, when fired under "standard" conditions, by about 50%. This is a considerable improvement over the stadia rangefinding/bullet drop compensation rifle scopes, which offer no increase in range of lethal accuracy over maximum point blank range because of the inherent inaccuracy of the stadia rangefinding system when applied to living targets. The Rangematic has a triangulation base of 9 inches and a magnification of 6 power.

The formula for determining the accuracy of a triangulation rangefinder is $2(\text{U.O.E.})=2(58.2R^2/BM)$. 2(U.O.E.)=the rangefinding error in yards, covering 95% of such rangefinding error. R=range in 1000 yard units. B=triangulation base in yards. M=magnification. Utilizing this formula, with the parameters of the Rangematic 1000, together with the Barnes Ballistics program, with the same Federal hunting ammunition used, supra, in determining the effect on the accuracy of ballistic trajectory compensation of the inaccuracy of stadia rangefinding applied to living targets, the following results are achieved: (1) the 7 mm Rem. Magnum has its range of lethal accuracy on deer sized game increased from a maximum point blank range of 366 yards to 540 yards, only 9 yards less than a 50% increase; (2) the 270 Win. has its range of lethal accuracy increased from a maximum point blank range of 346 yards to 500 yards, only 19 yards less than a 50% increase; (3) the 30—30 Winchester has its range of lethal accuracy increased from a maximum point blank range of 250 yards to 400 yards, 25 yards more than a 50% increase. This is a very impressive increase in the range of lethal accuracy as a result of triangulation rangefinding with an over the counter triangulation rangefinder, when compared to the abysmal results of stadia rangefinding, supra.

It is to be emphasized that the 50% increase in range of lethal accuracy has been achieved utilizing the Barnes Ballistics program, which allows for precise data inputting so that the ballistic trajectory is specific to particular ammo, etc. The Distran interchangeable bullet drop compensation scales (like the interchangeable bullet drop compensation elevation knobs discussed, supra, with respect to mechanical stadia rangefinding/bullet drop compensation scopes), because they offer only a very limited number of representative ballistic trajectories, and because they are not modifiable for specific field conditions, give a much lower level of accuracy. The Federal 7 mm Remington Magnum ammo is not represented in the "scale selector chart". Sticker 5 is close in bullet drop figures to this specific ballistic trajectory, but only at 50 yard intervals from 200 yards to 500 yards. However, even with this ultra-fiat trajectory ammo, with range intervals of 50 yards, bullet drop differential over the 50 yard intervals ranges from 6–9 inches at ranges from 300 to 500 yards, I.e,. the computer program (or very laborious and time consuming computation) must be used to provide a custom ballistic trajectory table at 20 yard intervals, so that bullet drop deviation is kept within the ±5 inch deviation limits required for lethal accuracy against deer size game. For the Federal 270 Win. ammo used, the problem is similar. Once again, the ammo used is not shown on the "scale selector chart", although sticker 7 approximates the ballistic trajectory. Bullet drop differentials of 12 inches are the result of the 50 yard intervals on the scale at ranges from 300 to 500 yards. Again, the computer program must be used to reduce the intervals to 20 yard intervals, and achieve the 50% increase in the range of lethal accuracy. With the 30—30 Winchester, the results are much worse, the scale sticker suggested for the 30—30 is not at all representative of its ballistic trajectory, so that the computer program is even more necessary. The interchangeable Distran scales offer only a small number of "representative" ballistic trajectories, and present, in fact, a very crude and inaccurate approximation of any given actual ballistic trajectory, even under "standard conditions". This crude and inaccurate manual system of bullet drop compensation does not even purport to offer any help if field conditions (i.e., temperature, wind, elevation, muzzle inclination, zero range, sight height, etc.) in the field vary from the hypothetical "standard conditions", as they almost always will. To achieve a level of accuracy in ballistic trajectory compensation commensurate with the high level of rangefinding accuracy of the Rangematic 1000, the hunter would have to carry into the field a portable personal computer, loaded with a small arms ballistic trajectory program such as Barnes Ballistics, together with appropriate instruments, such as an annemometer for crosswind determination, a level for muzzle inclination determination, etc. This is obviously ludicrous, since the expenditure of time involved in utilizing this equipment in the field, and making the appropriate adjustments to the scope, would result, more often than not, in the trophy wandering away long before the individual was ready to fire.

SUMMARY OF THE INVENTION

It is, therefore, an object of the present invention to provide an improved computerized device with rangefinder for ballistic trajectory compensation of small arms, which adds to the advantages of the prior art without their attendant disadvantages.

It is yet another object of the invention to provide as an integral part of the computerized device the highly accurate triangulation rangefinder.

It is yet another object of the invention to utilize the digital microcomputer, a small arms ballistic trajectory program, and data inputting capability allowing the shooter to input ammunition data, with range data being inputted from the triangulation rangefinder.

It is yet another object of all preferred embodiments of the invention to provide the shooter with broad data inputting capability, including rifle and sighting-in data, allowing the shooter and/or automatic sensors to input, among other data, atmospheric and muzzle elevation data.

It is yet another object of all preferred embodiments of the invention to minimize to negligible proportions any increase in bulk or weight on the rifle because of the device, thus allowing for comfortable carrying of the weapon, and swift, easy manipulation of the rifle for firing, by having all of the device in one embodiment, and in two other embodiments all of the device but a data output cordless transmission receiver and electric aiming mark adjustment system, entirely separate from the weapon.

It is yet another object of the invention, by having the triangulation rangefinder physically separate from the scope, to allow for the bulk and weight of a much longer triangulation base and a much higher magnification than would be possible if the triangulation rangefinder was physically integrated with the scope, thus allowing for very accurate rangefinding at very long ranges.

It is yet another object of all preferred embodiments of the invention, by having the computer and data inputting and data display systems integrated with the triangulation rangefinder and physically separate from the weapon, to allow for a much larger and more powerful computer, a much more extensively featured and detailed small arms ballistic trajectory program, larger and easier to use data inputting controls, larger solid state data inputting and data outputting displays, larger and therefore more accurate and reliable data inputting automatic sensor devices, than are feasible if the computer and data inputting and data display systems are physically integrated with the scope on the rifle.

In one novel embodiment of the invention, these and other objects of the invention are achieved by providing a solid state display of the outputted aiming mark adjustments required to compensate for range and other parameters so that the marksman, having made these adjustments to his telescopic sight windage and elevation screws, can aim the rifle where he wants the bullet to hit and have it impact at precisely that point.

In a second novel embodiment of the invention, these and other objects of the invention are acheived by providing an aiming mark adjustment data outputting cordless transmitter, together with a telescopic sight which includes an aiming mark adjustment data cordless transmission receiver and an electric aiming mark adjustment system slaved to the receiver, so that once inputted data including range data is processed by the computer's ballistic trajectory program and aiming mark adjustment is computed, the execution of aiming mark adjustment by displacing the aiming mark within the scope is carried out virtually instantaneously.

In a third novel embodiment of the invention, these and other objects of the invention are achieved by providing an aiming mark adjustment data outputting cordless transmitter, together with an external telescopic sight windage and elevation adjustment mount which includes an aiming mark adjustment data cordless transmission receiver and an electric scope displacement system slaved to the receiver, so that once inputted data including range data is processed by the computer's ballistic trajectory program and aiming mark adjustment is computed, the execution of aiming mark adjustment by displacing the telescopic sight is carried out virtually instantaneously.

DRAWING REFERENCE NUMERALS

Figure 1:
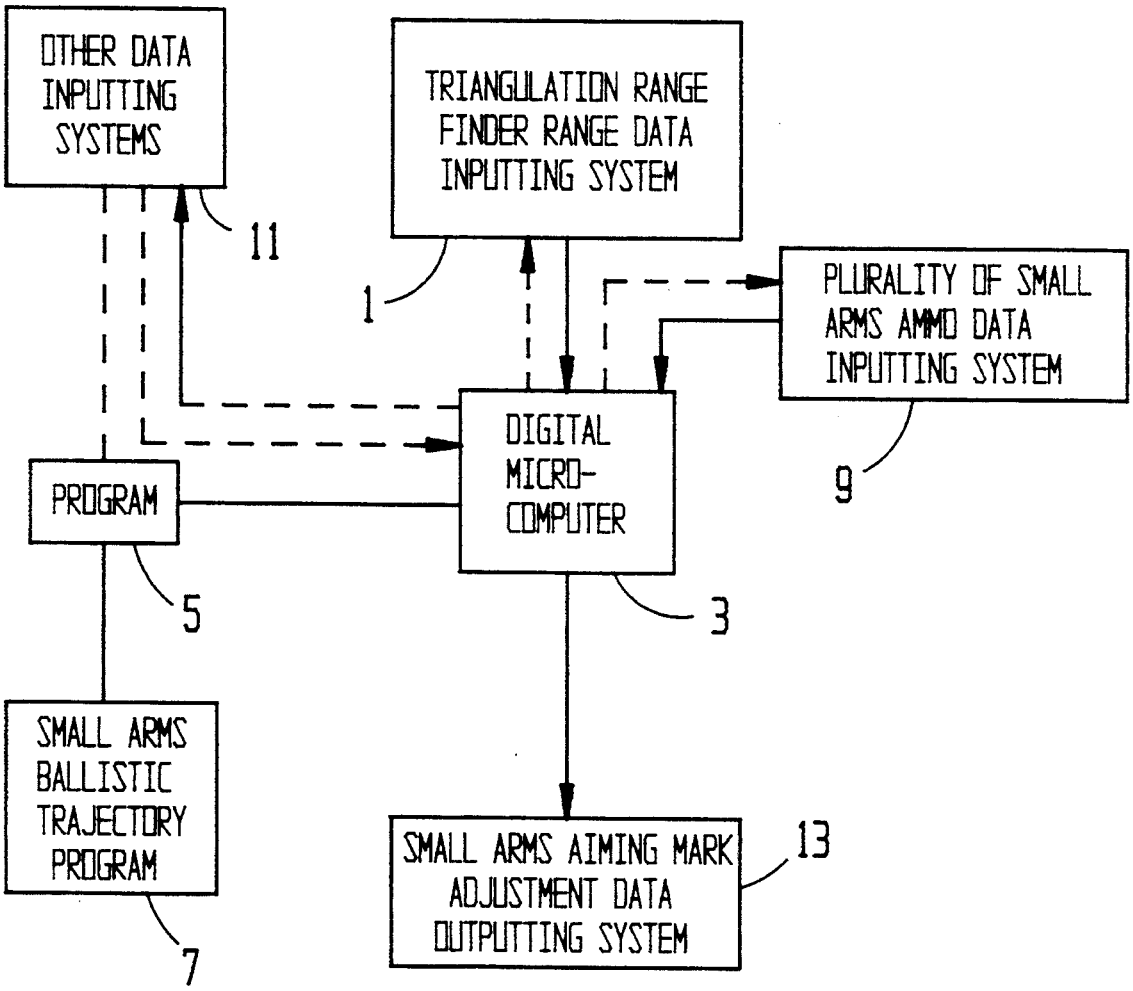
FIG. 1 is a block diagram and schematic illustration of the generic invention in its most general form.

1 triangulation range finder range data inputting system
3 digital microcomputer
5 program
7 small arms ballistic trajectory program
9 plurality of small arms ammo data inputting system
11 other data inputting systems
13 small arms aiming mark adjustment data outputting system
15 device
17 solid state display system for outputted aiming mark adjustment data
19 aiming mark adjustment data outputting transmitter
23 aiming mark adjustment data outputting receiver
25 electric aiming mark displacement system
27 temperature sensor
29 telescopic sight
31 electric telescopic sight displacement system
33 adjustable telescopic sight mount
35 range wheel and auto-data inputting activation switch
37 temperature callibration screws
39 image magnification telescope
41 rangefinder focusing ring
43 power on-off switch
45 data inputting buttons
47 crosswind sensors
49 level transducer
51 battery compartment covey
53 data output radio transmitter
55 data inputting and outputting LCD display screen 57 barometric pressure transducer
58 timer for electrical power and return to default setting
59 data inputting buttons activation switch
60 rifle
61 objective lense
63 occular lense
65 scope focusing ring
67 magnification adjustment ring
69 elevation adjustment screw
71 windage adjustment screw
75 scope bases
77 scope mounts
81 data output radio receiver
83 scope barrel
89 rear mount elevation screw
91 rear mount windage screw
95 LED indicator
99 spring housing
101 rear mount threaded screw fastener
103 rear mount top segment
105 rear mount bottom segment
107 rear mount hinge
109 electric erector tube w & e displacement system
111 electric telescopic sight w & e displacement system

DESCRIPTION Of EMBODIMENTS OF THE INVENTION

Although, throughout the description of the embodiments, reference will constantly be made to the use of the subject invention by hunters, it is obvious that the invention will also revolutionize the work of the military sniper or the marksman of a police SWAT team. Whenever precision long range shooting with a rifle is involved against a living target, whether the target is a game animal, an enemy soldier, or a dangerous armed felon, preferred embodiments of the subject invention will increase the range of lethal accuracy of the rifle by more than 100% beyond maximum point blank range, without adding significant bulk, weight, or cumbersomeness to the rifle and telescopic sight.

Referring to the drawings, FIG. 1 is a schematic illustration and block diagram of the subject invention in its generic embodiment, i.e., its most general form. Digital microcomputer 3 refers to the computer hardware architecture broadly defined, and includes, inter alia, in addition to the computer itself, all data inputting and outputting circuits (but not the data inputting and outputting devices connected to these circuits), a battery for electrical power, an on-off switch, and in preferred embodiments, a timer to switch off power automatically to conserve the battery (as suggested in U.S. Pat. No. 4,531,052). Such schematic representation and broad definition of digital microcomputer 3 is sufficient disclosure for those knowledgeable in the prior art of computerized devices with stadia rangefinders for ballistic trajectory compensation of small arms.

Triangulation rangefinder range data inputting system 1 is a schematic representation of a triangulation rangefinder as a range data inputting device for the digital microcomputer 3. Those knowledgeable in the prior art of computerized devices with stadia rangefinders for ballistic compensation of small arms know how the rotation of the knob controlling the stadia rangefinder communicates to the computer the determined range, by, inter alia, a shaft encoder in the control knob (U.S. Pat. No. 4,965,439). U.S. Pat. No. 4,561,204 discloses a range data input knob for a computerized device for small arms ballistic trajectory compensation, independent of a stadia rangefinder. Those knowledgeable in the prior art of triangulation rangefinders will be familiar with the rotating range readout wheel or disk, such as that of the Rangematic 1000. By appropriately calibrating the range data inputting sub-systems disclosed in the prior art of computerized devices for small arms ballistic trajectory compensation to the rotating range readout wheel or disk of the triangulation rangefinder and physically connecting or engaging the two, and eliminating (from prior art computerized devices with stadia rangefinders for small arms ballistic trajectory compensation) any elements of the stadia rangefinder that are present, the triangulation range finder range data inputting system 1 comes into being, based on this wedding of the two disparate prior arts, that of the triangulation rangefinder, and that of the computerized device for small arms ballistic trajectory compensation.

The plurality of small arms ammo data inputting system 9 is as disclosed in U.S. Pat. Nos. 4,531,052; 4,777,352; 4,965,439, and allows the shooter to input, inter alia, the muzzle velocity and ballistic coefficient of the ammo he is using. Other data inputting systems 11 refers to, inter alia, atmospheric, sighting in, and muzzle inclination data inputting systems, as disclosed in U.S. Pat. Nos. 4,531,052; 4,777,352; 4,965,439; 4,561,204. Other data inputting systems 11, as disclosed in the prior art, may be of three types: standard values in program 5, user operated data inputting buttons, automatic sensor devices. Program 5 is broadly defined to include all permanent (i.e., not temporary "programming" in the sense of user data inputting) programming of the digital microcomputer 3, except for the small arms ballistic trajectory program 7.

Figure 2:
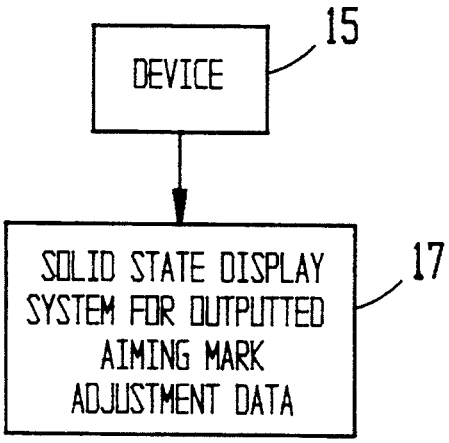
FIG. 2 is a block diagram and schematic illustration of that species of the invention in which aiming mark adjustment data is outputted on a solid state display system.
Figure 3:
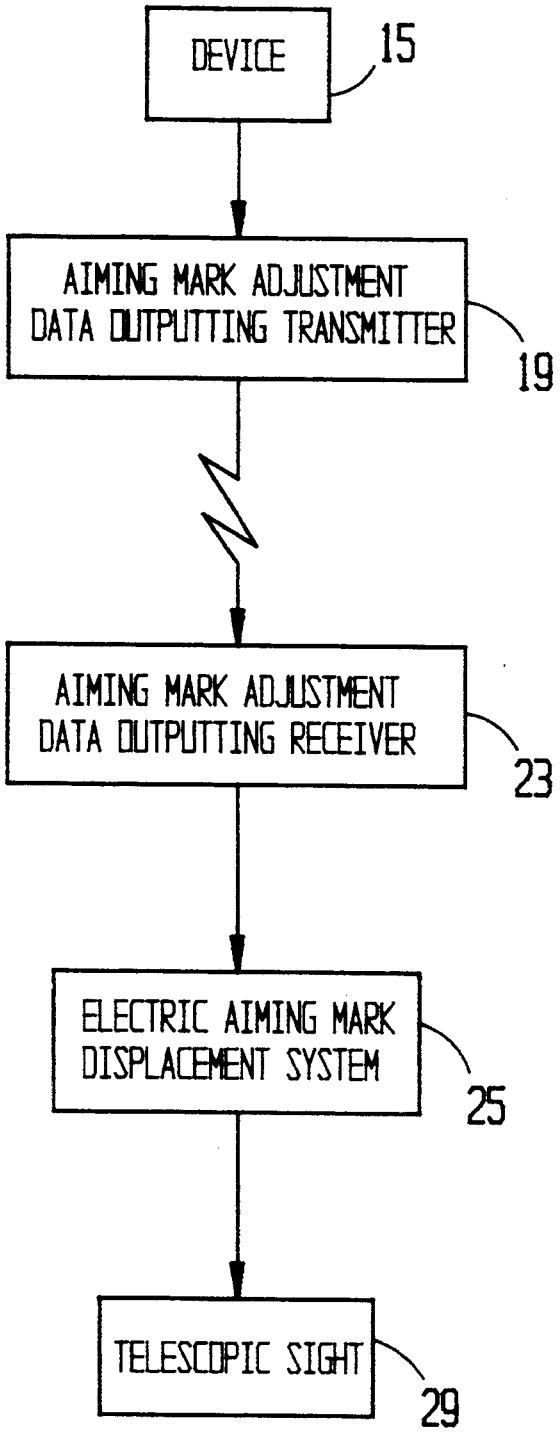
FIG. 3 is a block diagram and schematic illustration of that species of the invention in which aiming mark adjustment data is outputted by means of cordless transmission to a telescopic sight to electrically displace the aiming mark within the telescopic sight to conform to the outputted aiming mark adjustment data.
Figure 4:
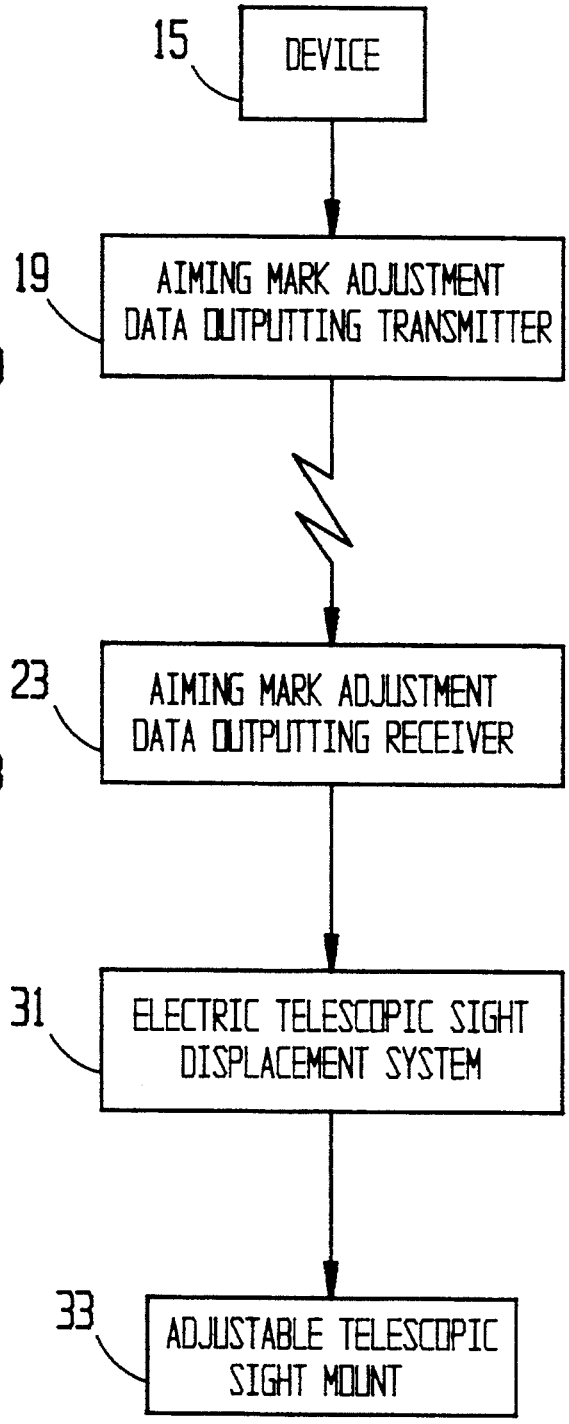
FIG. 4 is a block diagram and schematic illustration of that species of the invention in which aiming mark adjustment data is outputted by means of cordless transmission to an external telescopic sight windage and elevation adjustment mount to electrically displace the telescopic sight to conform to the outputted aiming mark adjustment data.

Program 5 thus includes, inter alia, the operating system, as well as programming for operation and integration of all data inputting and data outputting systems, and would include, for example, programming for data inputting and data outputting solid state (i.e., LED or LCD) data displays. Those knowledgeable in the prior art of computerized devices with stadia rangefinders for ballistic trajectory compensation of small arms will be familiar with such a program 5 for a digital microcomputer 3. The small arms ballistic trajectory program 7 is as disclosed in such powerful "off the shelf" personal computer programs as Barnes Ballistics program, Sierra Bullets Exterior Ballistics program, and also in a more rudimentary form in the prior art of computerized devices with stadia rangefinders for ballistic trajectory compensation of small arms. Small arms aiming mark adjustment data outputting system 13 refers to the mechanisms whereby the outputted aiming mark adjustment data is provided to the shooter for aiming mark (usually, the crosshairs of a telescopic sight) adjustment to be carried out so that the shooter can aim at his target confident that the bullet will impact at the point of aim. FIGS. 2, 3, and 4, to be described, infra, illustrate three species of small arms aiming mark adjustment data outputting system 13, and, correlatively, three species embodiments of the invention.

In FIG. 1, the arrows indicate the direction of data flow. The solid arrows are for data flow present in all embodiments of the subject invention. The dotted line arrows are for data flow present in some embodiments but not in others. Where plurality of small arms ammo data inputting system 9 utilizes a solid state display system such as an LCD for data inputting display, the digital microcomputer 3 would be utilized for the display, and thus the dotted arrow from reference numeral 3 to reference numeral 9. On the other hand, if in a rudimentary version of the subject invention, the data inputting display for plurality of small arms ammo data inputting system 9 was a small number of choices inscribed on the housing of the device in a circular array with a dial pointer at its center as the ammo data inputting control, then there would be no data outflow from the digital microcomputer 3 to plurality of small arms ammo data inputting system 9. The dotted line arrows from digital microcomputer 3 to triangulation rangefinder range data target inputting system 1 and other data inputting systems 11 represent embodiments in which the digital microcomputer 3 is assisting or controlling certain aspects of the operations of these systems. The dotted arrow running from other data inputting systems 11 to digital microcomputer 3 illustrates those embodiments in which other data inputting systems are either operated by the user or are automatic sensor devices. The dotted line connecting other data inputting systems 11 to program 5 illustrates those embodiments in which one or more other data inputting systems 11 are standard values in program 5.

FIG. 2 illustrates that species embodiment of the subject invention in which aiming mark adjustment data is outputted on a solid state data display system. Device 15, consisting of drawing reference numerals 1, 3, 5, 7, 9, 11, is a schematic representation of all subsystems of the generic embodiment of the subject invention illustrated in FIG. 1 except small arms aiming mark adjustment data outputting system 13. Solid state display system for outputted aiming mark adjustment data 17 is the species in FIG. 2 of the generic drawing reference numeral 13 in FIG. 1. Solid state display system for outputted aiming mark adjustment data 17 refers to an LCD or LED screen on the device which, with appropriate instructions in program 5, will display the outputted aiming mark adjustments required for the point of aim and the point of impact of the bullet to be congruent. The arrow shows the direction of data flow.

The adjustments that are displayed would in preferred embodiments include elevation and windage in both minutes of angle (henceforth, "moa") and inches. Virtually all modern rifle telescopic sights have their elevation and windage dials calibrated in moa. The hunter, upon obtaining the readout, would make the appropriate adjustments on his scope in a matter of seconds, and would then be able to aim and fire, confident that the bullet would hit where he was aiming. After killing his trophy, the hunter would then readjust the elevation and windage dials of his scope back to the original zero. The Leupold & Stevens VARI-X III model variable power rifle scopes, which include on the windage and elevation dials a movable pointer which indicates the original zero as field adjustments are made, and which have very clearly marked 15 moa dials in ¼ moa increments, are one example of a good "off the shelf" rifle scope companion for this solid state display species embodiment of the invention. For most shooting at long range, the time, about 15 seconds, expended (including removal of the windage and elevation dial caps) adjusting the windage and elevation dials of the scope to conform to the outputted data would not be detrimental to obtaining a shot at the prey. In those rare instances, where speed is critical and there is only enough time for the hunter to aim the rifle and fire if the prey is not to get away, the holdover readouts (in inches) would be utilized, and the hunter would not aim at the point where he wanted the bullet to strike, but at that point (henceforth, styled the "compensatory aiming point"), indicated by the data readout, which would result in the bullet hitting where he disired.

The compensatory aiming point, unlike the adjustment of the windage and elevation dials which results in precise congruence of the point of aim and the point of impact, is, of course, an approximation. It requires using as a holdover measurement reference the target. As has already been noted, supra, there is a substantial range of variation in size for the target animals. This variation will produce a margin of error in the estimation of the compensatory aiming point location. However, the consequence of this margin of error in deviation of actual point of impact from intended point of impact is very small in relation to the consequence in deviation of point of impact from point of aim (the intended point of impact) of the margin of error in stadia rangefinding resulting from the same size variation in the target animal.

Assume that the Federal 270 Winchester factory load with the Sierra 150 grain sbt bullet is being utilized and the range to target is 500 yards. The trajectory is computed using the Barnes Ballistics program with a 200 yard zero range, 1.5" sight height, and atmospheric conditions and muzzle elevation at standard values. Assume that the target is a deer with a size reference standard of 18", shoulders to chest, and assume that the standard size deviation is ±20%, which translates to ±3.6". The deviation of point of impact from point of aim if stadia rangefinding is used is −20% rangefinding error=22" deviation, while +20% rangefinding error=30" deviation. But the deviation of actual point of impact from intended point of impact using the holdover readout of the subject invention, and relying on the deer, shoulders to chest, as the measurement reference, is only 8.6" (Bullet drop at 500 yards is 43". Dividing the bullet drop by the reference measure of 18", and multiplying by 3.6", the error for each use of the 18" size reference, the deviation of point of impact from point of aim is found to be 8.6".) Although 8.6" is greater than the 5" which is allowed for lethal accuracy, it is a small fraction of the 22"–30" deviation resulting from stadia rangefinding. Holdover using the holdover data readout of this species embodiment of the subject invention does not provide the precise accuracy that can be obtained by adjusting the scope elevation & windage controls to conform to the moa readout. However, the use of the holdover data readout, if a very fast shot is necessary, will produce a probable hit on the target animal, and is far superior to the gross inaccuracy and high probability miss that will result from either using stadia rangefinding or simply guessing.

FIG. 3 is a block diagram and schematic illustration of the cordless transmission telescopic sight species embodiment. Once again, the device 15 is a schematic representation of drawing reference nos. 1, 3, 5, 7, 9, and 11 of FIG. 1, excluding only small arms aiming mark adjustment data outputting system 13. In FIG. 3, drawing reference numerals 19, 23, 25, and 29 are in combination the species of the generic drawing reference numeral 13 in FIG. 1. Aiming mark adjustment data outputting transmitter 19 is physically integrated with and forms a single unit with the device 15, while aiming mark adjustment data outputting receiver 23 and electric aiming mark displacement system 25 are physically integrated with and form a single unit with the telescopic sight 29 which is electronically slaved to the device 15 when the aiming mark adjustment data outputting receiver 23 is activated. Electric aiming mark displacement system 25 is the system for electrically adjusting the aiming mark, usually a crosshairs reticle, of the telescopic sight 29. The electronic systems (reference nos. 23, 25) that are part of telescopic sight 29 include, inter alia, an on-off switch and a battery, and in preferred embodiments a timer including an automatic default setting return of the aiming mark to the zeroed in position. The arrows show the direction of data flow. The lightening bolt arrow shows that from reference number 19 to reference number 23, the data flow is by means of cordless transmission such as radio, infra-red, acoustic, or microwave.

Telescopic sight 29 is illustrated schematically because those knowledgeable in the prior art of telescopic sights of the modern erected image type, whether fixed power or variable power, are familiar with all the optical and mechanical subsystems of such scopes, and accordingly, schematic illustration is sufficient disclosure. Those familiar with the prior art of computerized devices including rangefinders for ballistic trajectory compensation of small arms are knowledgeable about different embodiments of electric aiming mark displacement system 25 such as the four different embodiments of such systems disclosed as subsystems in U.S. Pat. Nos. 4,531,052; 4,777,352; 4,965,439, and so schematic representation of electric aiming mark displacement system 25 is adequate disclosure. Those familiar with this prior art know that these same embodiments of the electric aiming mark displacement system 25 can be utilized for windage displacement as well as elevation displacement by utilizing one system horizontally (i.e., windage adjustment axis) as well as one vertically (i.e., elevation adjustment axis).

Those familiar with the prior art of personal computer data output and data input devices are familiar with cordless data transmission systems. The IBM PC Jr. utilized infra-red transmission of data from the keyboard to the computer. Cordless local area network systems, relying on radio transmission of data from one personal computer to another, such as IBM's PC Radio, Apple's Data PCS, are available, as is Motorola's Altair microwave transmission system. The Logitech Cordless Radio Mouseman utilizes a very tiny radio transmitter (together with data outputting digital computer circuitry in the mouse for outputting from the mouse to the transmitter contained in the mouse the horizontal and vertical movement of the mouse) and a very tiny radio receiver(together with data inputting digital computer circuitry with the radio receiver attached to the personal computer for inputting to the personal computer from the mouse radio transmitter) for ultra short distance (i.e., no more than 10 feet) cordless data transmission of horizonal and vertical mouse movements. Of course, for any PC mouse, with cord or cordless, a mouse driver program is required to be installed into the PC for the mouse to be an operational data input device (the movements of the mouse moving an arrowhead pointer on the PC display screen) for any given application program.

U.S. Pat. No. 4,754,268, issued to Akira Mori in 1988, gives an excellent detailed analysis of the preferred system of cordless data transmission for the subject invention, namely radio transmission. U.S. Pat. No. 4,754,268 (henceforth, sometimes referred to as "the Mori patent") discloses a personal computer mouse system in which data transmission from the mouse to the computer is by means of radio rather than a cord connection, with a miniature radio transmitter in the mouse and a miniature radio receiver to be attached to the computer. The prior art of personal computer cordless mouse systems can be readily translated to the cordless transmission species embodiments of the subject invention. In both the cordless mouse system of the Mori patent and the cordless transmission species embodiments of the subject invention, vertical and horizontal displacement of a mark (the mouse pointer, the aiming mark) is being produced. In the Mori patent, the displacement of the mouse pointer on the personal computer CRT or LCD screen is slaved to the mouse movement data transmitted from the mouse, while in the cordless transmission embodiments of the subject invention, the displacement of the aiming mark is slaved to the bullet movement (i.e., ballistic trajectory) data output of device 15.

In FIG. 3 of the subject invention, the electric aiming mark displacement system 25 could be that disclosed in FIG. 10 of U.S. Pat. No. 4,531,052, in which the displaced aiming mark is shown on an LCD in a scope focal plane. In this translation, electric aiming mark displacement system 25 would include a digital microprocesser (in addition to digital microcomputer 3 in device 15) in the scope, with sufficient rudimentary programming (translating transmitted data from device 15 into instructions to adjust the aiming mark in this LCD embodiment of electric aiming mark displacement system 25) to carry out the displacement of the aiming mark, as well as in any preferred embodiments to return to default setting and switch off electrical power after an appropriate pre-set time lapse. Those familiar with the prior art of computerized devices for ballistic trajectory compensation of small arms know that the hereinabove rudimentary programming, analagous to the mouse driver program for a PC mouse, referred to, supra, is inherent in the programming of the computer in U.S. Pat. Nos. 4,531,052, 4,777,352, and 4,965,439. In preferred embodiments of the subject invention, reference numbers 23 and 25 would displace the erector tube as disclosed in U.S. Pat. No. 4,965,439. As noted, supra, electric aiming mark displacement system 25 would in such a preferred embodiment include a digital microprocessor with rudimentary programming to execute the displacement as per the data transmitted to the aiming mark adjustment data outputting receiver 23, and also after a fixed time, return the erector tube to the default zeroed in position as well as turning off electrical power.

In addition to radio transmission of data, the prior art of personal computer input device also discloses other means of cordless data transmission, including, inter alia, acoustical (U.S. Pat. No. 4,654,648), infra-red (U.S. Pat. No. 4,550,250), and mixed acoustical and infra-red (U.S. Pat. 4,578,674), and the new Motorola cordless LAN system utilizes microwave transmission.

It is, therefore, adequate disclosure for those knowledgeable in the prior art of personal computer data input and data output devices to schematically illustrate aiming mark adjustment data outputting transmitter 19 and aiming mark adjustment data outputting receiver 23.

Preferred embodiments of the cordless transmission telescopic sight species embodiment illustrated in FIG. 3 would utilize radio transmission rather than alternatives such as infrared, because then the device 15 can transmit to the telescopic sight 29 mounted on the rifle without the neccessity that the telescopic sight 29 and the device 15 be in a particular juxtaposition in relation to each other. Although more detailed illustration of a preferred embodiment of the cordless transmission telescopic sight species embodiment will be presented infra in FIGS. 5, 6 & 7, it should be noted that all preferred embodiments of this species embodiment would have timers on both the device 15 and the telescopic sight 29 for two purposes: (1) to minimize battery drain if the hunter forgets to turn either the device 15 or the telescopic sight 29 off, (2) to return the device 15 and the telescopic sight 29 to their default settings (i.e., the telescopic sight 29 aiming mark would be returned automatically after the lapse of a certain time to its zeroed in position).

The cordless transmission telescopic sight species embodiment offers very fast operation combined with great accuracy. After switching on and utilizing the device 15, the hunter switches off the safety on his rifle and simultaneously switches on the telescopic sight 29 (thus switching on the cordless aiming mark adjustment data outputting receiver 23 and the electric aiming mark displacement system 25), raises the rifle, waits for a fraction of a second for a visible (e.g., LED or LCD) indicator in preferred embodiments that aiming mark adjustment is completed, aims and fires. In comparing the species embodiments of FIGS. 2 & 3, the cordless transmission telescopic sight offers the very important advantage of substantially superior speed in operation at a greater monetary cost (if the hunter already possesses a telescopic sight), since the hunter must throw away his current scope while buying the new telescopic sight 29.

FIG. 4 is a block diagram and schematic illustration of the cordless transmission adjustable telescopic sight mount species embodiment. Once again, the device 15 is a schematic representation of drawing reference nos. 1, 3, 5, 7, 9 and 11 of FIG. 1, excluding only small arms aiming mark adjustment data outputting system 13. In FIG. 4, drawing reference numerals 19, 23, 31, and 33 are in combination the species of the generic drawing reference numeral 13 in FIG. 1. Aiming mark adjustment data outputting transmitter 19 is again an integral part of a unit including device 15, while aiming mark adjustment data outputting receiver 23 and electric telescopic sight displacement system 31 are integral parts of the adjustable telescopic sight mount 33 which is electronically slaved to the device 15 when the aiming mark adjustment data outputting receiver 23 is activated and device 15 with aiming mark adjustment outputting transmitter 19 is also activated. Electric telescopic sight displacement system 31 is the system for electrically adjusting the aiming mark, by adjusting the vertical and horizontal position of a standard (i.e., "off the shelf" non-computerized, mechanical, fixed power or variable power, and with zeroing in adjustments made on the scope's windage and elevation dials, not on the adjustable telescopic sight mount 33) telescopic sight. The electronic systems (reference nos. 23, 31) that are part of adjustable telescopic sight mount 33 include, inter alia, an on-off switch and a battery, and in preferred embodiments, a timer designed both to switch off power automatically after the lapse of a certain time and to automatically return the adjustable telescopic sight mount 33 to its zero-zero displacement default setting (i.e., return the telescopic sight to its zeroed in position). The arrows show the direction of data flow. The lightening bolt arrow shows that from reference number 19 to reference number 23, the data flow is by means of cordless transmission such as radio or infra-red.

Adjustable telescopic sight mount 33 is illustrated schematically because those knowledgeable in the prior art of adjustable telescopic sight mounts are familiar with all the mechanical subsystems of such adjustable scope mounts, and accordingly, schematic illustration is sufficient disclosure. U.S. Pat. No. 2,004,489, issued to Kuhn in 1935, discloses the external telescopic sight mount adjustable for windage and elevation. The windage and elevation adjustable telescopic: sight mount is designed by Kuhn to be used with a scope containing no internal windage and elevation adjustment system. U.S. Pat. No. 4,397,107 discloses a bullet drop compensating scope mount in which the elevation screw, marked in range increments on the dial, has a thread pitch corresponding to a given ballistic trajectory, so that if the range is known, ballistic trajectory compensation can be achieved for ammunition with a given specific ballistic trajectory at standard parameter values by turning the dial to the known range mark.

The cordless transmission telescopic sight species embodiment of FIG. 4, as noted supra, is designed specifically for use with standard rifle telescopic sights which do have internal (usually erector tube displacement by spring biased windage and elevation screws, which all knowledgeable in the prior art of rifle telescopic sights are familiar with windage and elevation adjustment systems. Those familiar with the prior art of computerized devices including rangefinders for ballistic trajectory compensation of small arms are knowledgeable about the electric aiming mark displacement system disclosed as a subsystem in U.S. Pat. No. 4,965,439, in which the displacement system turns a spring biased screw to displace the erector tube within the telescopic sight. Electric telescopic sight displacement system 31 utilizes the same electric displacement subsystem as illustrated in U.S. Pat. No. 4,965,439, except instead of turning a spring biased screw to displace the erector tube within the telescopic sight, it turns a spring biased screw (or screws, if windage as well as elevation is being subjected to computer controlled adjustment) to displace the telescopic sight itself as disclosed in U.S. Pat. Nos. 2,004,489 & 4,397,107. Preferred embodiments of electric telescopic sight displacement system 31 would include a digital microprocessor with rudimentary programming to execute the displacement as per the data transmitted to the aiming mark adjustment data outputting receiver 23, and also after a fixed time, return the telescopic sight to the default zeroed in position as well as turning off electrical power. Accordingly, schematic representation of electric telescopic sight displacement system 31 is sufficient disclosure. Aiming mark adjustment data outputting transmitter 19 and aiming mark adjustment data outputting receiver 23, have been examined, supra, with reference to FIG. 3.

Preferred embodiments of the cordless transmission telescopic sight mount species embodiment illustrated in FIG. 4 would utilize radio transmission rather than other alternatives such as infrared, because then device 15 can transmit to the adjustable telescopic sight mount 33 mounted on the rifle without the neccessity that the adjustable telescopic sight mount 33 and the device 15 be in a particular juxtaposition in relation to each other. As noted, supra, all preferred embodiments of the FIG.

4 species embodiment will have a timer on device 15 and another timer on adjustable telescopic sight mount 33, to minimize battery drain and to return device 15 and adjustable telescopic sight mount 33 to their default settings.

The cordless transmission adjustable telescopic sight mount species embodiment offers very fast operation combined with a very high level of accuracy, as with the cordless transmission telescopic sight species embodiment. After switching on and utilizing the device 15, the hunter switches off the safety on his rifle and simultaneously switches on the adjustable telescopic sight mount 33 (thus switching on the aiming mark adjustment receiver 23 and the electric telescopic sight displacement system 31), raises the rifle, wails for a fraction of a second for a visible (e.g., LED or LCD) indicator in preferred embodiments that aiming mark adjustment is completed, aims and fires. In comparing the species embodiment of FIG. 4 with the species embodiments of FIGS. 2 & 3, the cordless transmission adjustable telescopic sight mount offers the important advantage of very fast operation over the species embodiment of FIG. 2, and the important advantage of cheapness over the species embodiment of FIG. 3, since the hunter can keep his current scope when buying the species embodiment illustrated in FIG. 4.

Figures 5, 6:
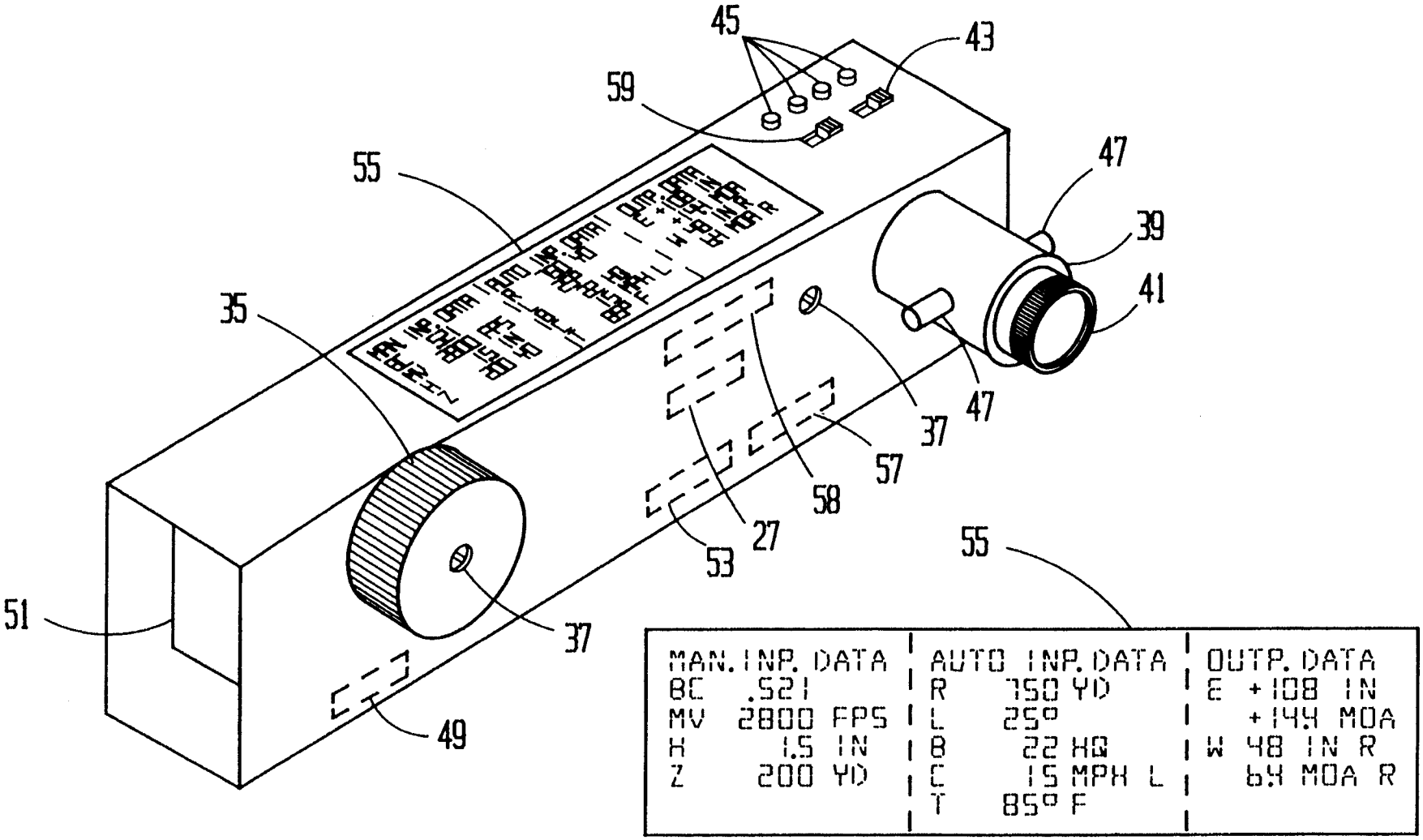
FIG. 5 is an external perspective view of a preferred embodiment of that species of the invention illustrated schematically in FIG. 2 combined with an aiming mark adjustment data output transmitter.
FIG. 6 is an enlarged illustration of the data LCD display screen illustrated in smaller size in FIG. 5, showing more clearly the illustrated data readout example.

FIG. 5 is an external perspective view of a preferred embodiment of the invention combining that species of the invention illustrated schematically in FIG. 2 together with reference numeral 19 illustrated schematically in FIGS. 3 & 4. The battery compartment cover 51 is the cover over the compartment where the battery, not shown, is lodged, which provides the electrical power. The hunter first, before beginning his hunt, activates manual data inputting with the power on-off switch 43 and the data inputting buttons activation switch 59. The purpose of the separate data inputting buttons activation switch 59 is to preclude accidental, unintended manual data inputting on the data inputting buttons 45 when the instrument is later activated in the course of the hunt for automatic inputting and outputting of data. In the illustrated data inputting and outputting LCD display screen 55, one section is titled "man. inp. data", an abreviation for "manually inputted data", and it is this section of the data inputting and outputting LCD display screen 55 which shows the data inputted using data inputting buttons 45.

In FIG. 6, the data inputting and outputting LCD display screen 55 illustrated in FIG. 5 is enlarged so that the particular data illustrated in the example is more easily readable. In the example illustrated in FIGS. 5 & 6, the hunter is using a 270 Winchester rifle, and has handloaded his ammunition with the Nosier Ballistic Tip 150 gr spitzer boat tail bullet, which has a ballistic coefficient under standard conditions of 0.521, at a muzzle velocity of 2,800 fps. The height of the scope above the bore (i.e., the distance from the center of the scope to the center of the bore) is 1½ inches. The range at which he zeros in his rifle so that the center of the crosshairs is congruent with the point of impact of the bullet is 200 yards. This data he has inputted, using the data inputting buttons 45, as is disclosed in U.S. Pat. Nos. 4,531,052; 4,777,352; 4,965,439.

He would now switch off power using the power on-off switch 43, and also switch off the data inputting buttons activation switch 59. If he forgets to switch off these buttons, the timer for electrical power and return to default setting 58 will do so; in this instance of manual data inputting, "default setting" does not mean erasing the manually inputted data, but instead means turning off the data inputting buttons activation switch 59. When power on-off switch 43 is on, the data inputting and outputting LCD display screen 55 is on; when power on-off switch 43 is off, the data inputting and outputting LCD display screen 55 is off. The timer for electrical power and return to default setting 58 is shown schematically. This is, however, sufficient disclosure to those knowledgeable in the prior art of computerized ,devices including rangefinders for ballistic trajectory compensation of small arms, since such a timer is disclosed as a subsystem in U.S. Pat. Nos. 4,531,052; 4,777,352; 4,965,439. Indeed, such timers are widely used in other computerized devices, such as, for example, computerized 35 mm single lens reflex autofocus cameras.

In addition to electronic manual data inputting just before he begins the hunt, the hunter also will want to make several mechanical adjustments. In the first place, he will want to adjust the rangefinder focusing ring 41 on the image magnification telescope 39 for clarity of view with his: particular vision. Those knowledgeable in the prior art of telescopes and telescopic sights will be familiar with such focusing rings. Temperature calibration screws 37 are for recalibration of the two reflecting elements (not shown) of the triangulation rangefinder for accurate triangulation, in the event of a major temperature shift from prior calibration. The reason for the recalibration in the event of a major temperature shift is that with such a small angle of triangulation, the temperature change induced expansion-contraction of the material holding the reflecting elements in the device will shift the positions of the reflecting elements enough so that precise accuracy of triangulation rangefinding will be degraded. Those knowledgeable in the prior art of triangulation rangefinders are familiar with such temperature recalibration systems, and therefore, this is sufficient disclosure. Indeed, the Rangematic 1000 includes just such a system.

In considering this preferred embodiment, illustrated in FIG. 5, or, indeed, any embodiment, very important considerations are the length of the triangulation base and the magnification of the image magnification telescope 39. The formula for the determination of the rangefinding accuracy of any particular triangulation rangefinder has been presented, supra, in the "Background of the Invention" section, and the formula was therein applied for three particular ammunition loads (Federal 7 mm Rem. Mag., 165 gr sbt; Federal 270 Win., 150 gr sbt; Federal 30—30 Win., 170 gr rn) for a deer sized lethal zone (10" diameter), to determine that the Rangematic 1000 (triangulation base of 9", magnification of 6X) extends the range of lethal accuracy about 50% beyond maximum point blank range. On the one hand, the longer the length of the triangulation base and the higher the magnification, the more accurate the triangulation rangefinding and the greater the extension of the range of lethal accuracy. On the other hand, if the size of the instrument is too large, it becomes uncomfortable to carry in the field, and difficult to manipulate for swift utilization when the prey is sighted. Thus, a proper balance must be achieved between a size that is small enough to allow for comfortable carriage and easy manipulation in the field, and on the other hand large enough to extend the range of lethal accuracy substantially beyond maximum point blank range. A good balance is struck with a triangulation base of 13.5"

and 18X magnification. With these triangulation base and magnification parameters, the range of lethal accuracy is extended by more than 100% beyond maximum point blank range, while the size increase of the instrument is well within comfortable limits for easy carrying and fast manipulation in the field.

The digital microcomputer 3 containing the program 5 and the small arms ballistic trajectory program 7, supra, FIG. 1, not shown in the external illustration of FIG. 5, is contained within the instrument illustrated in FIG. 5. In so far as the additional accretion of size, bulk, and weight of the digital microcomputer 3, the data inputting and outputting LCD display screen 55, and the various data inputting systems, the level of miniaturization disclosed by the prior art of palmtop personal computers (the Poqet PC and the Hewlet Packard 95 LX Palmtop PC are good examples), the prior arts of computerized instruments such as computerized single lens reflex 35 mm cameras, as well as the prior art of computerized devices with rangefinders for ballistic trajectory compensation of small arms disclosed in U.S. Pat. Nos. 4,561,204; 5,531,052; 4,777,352; and 4,965,439, makes manifest that the size, weight and bulk of the entire instrument illustrated in FIG. 5 should be no greater than that of many long barreled handguns which hunters commonly carry in waist holsters when going hunting. The use of a waist holster would be one method of comfortably carrying the instrument illustrated in FIG. 5 that would allow for very fast access in the field.

When the hunter sights his prey, he would remove the instrument from its holster, activate the power on-off switch 43, and holding the device horizontally at eye level, peer through the image magnification telescope 39, while operating the range wheel and auto-data inputting activation switch 35. The range wheel and auto-data inputting activation switch 35 serves three seperate functions: (a) By rotating it, one of the triangulation reflectors is rotated, thus allowing the user to merge the separate images of the target reflected by the two triangulation reflectors into a single image, as examined, supra, and exemplified in the Rangematic 1000; (b) Simultaneously, in the preferred embodiment illustrated in FIG. 5, when power on-off switch 43 is in the on position, and data inputting buttons activation switch 59 is in the off position and the wheel of drawing reference numeral 35 is rotated, then crosswind sensors 47, temperature sensor 27, level transducer 49, and barometric pressure transducer 57 are activated (These sensors are illustrated schematically in FIG. 5 as they also are in U.S. Pat. No. 4,561,204.); (c) When image merger is completed, drawing reference numeral 35 is to be pulled out, which serves to input into the computer the range determined the operation of the triangulation rangefinder, as well as data determined by drawing reference numerals 49, 27, 57, and 47. The digital microcomputer 3 will now process the inputted data, will show on the data inputting and outputting LCD display screen 55 the auto inputted data and also the outputted data,(-which is to say the windage and elevation adjustments that must be made to the scope so that the hunter can aim at his target and have the bullet hit where he aims), and will activate the tiny radio transmitter called the data output radio transmitter 53, and start broadcasting the outputted data. After a predetermined time has elapsed, the timer for electrical power and return to default setting 58 will simultaneously erase auto-inputted data and outputted data, turn off data inputting and outputting LCD display screen 55 and data output transmitter 53, and switch off electrical power.

The "manually inputted data" of the data readout example illustrated in FIGS. 5 & 6 in the data inputting and outputting LCD display screen 55 has been examined, supra. For the "auto inp. data" (abreviation of "auto-inputted data"), the range "R" is 750 yards, the angle of elevation of the muzzle "L" is 25 degrees, barometric pressure is 22 inches of mercury, a crosswind of 15 mph is blowing in a leftward direction, and ambient temperature is 85 degrees Farenheit. The Barnes Ballistics program has been used to compute the "outp. data"(abreviation for "outputted data"), based on the inputted data,the elevation "E" is a holdover correction of plus 108 inches or an adjustment on the scope elevation screw of plus (i.e., counterclockwise by industry convention to move point of impact upward) 14.4 minutes of angle, while the windage "W" is a holdover (i.e., in the case of windage adjustment, actually a hold to the side) of 48 inches to the right or a counterclockwise (by industry convention) adjustment on the scope windage screw of 6.4 minutes of angle to move the point of impact to the right.

The hunter who utilizes the preferred embodiment illustrated in FIG. 5 has three alternative options for utilizing the data output: (1) holdover, utilizing the outputted windage and elevation compensation adjustments presented in inches; (2) manual adjustment of the windage and elevation screws on the scope, utilizing the minute of angle readouts; (3) reliance on either the cordless transmission telescopic sight species embodiment illustrated in FIG. 3 or the cordless transmission adjustable telescopic sight mount species embodiment illustrated in FIG. 4. As noted, supra, the first option is fast, but provides approximate rather than precise ballistic trajectory compensation; the second option provides precise ballistic trajectory compensation, but requires a pause of about 15 seconds while first the windage and elevation screw caps are removed and then the windage and elevation screws on the scope are adjusted; both species embodiments of the third option combine very fast operation and very precise ballistic trajectory compensation.

Figure 7:
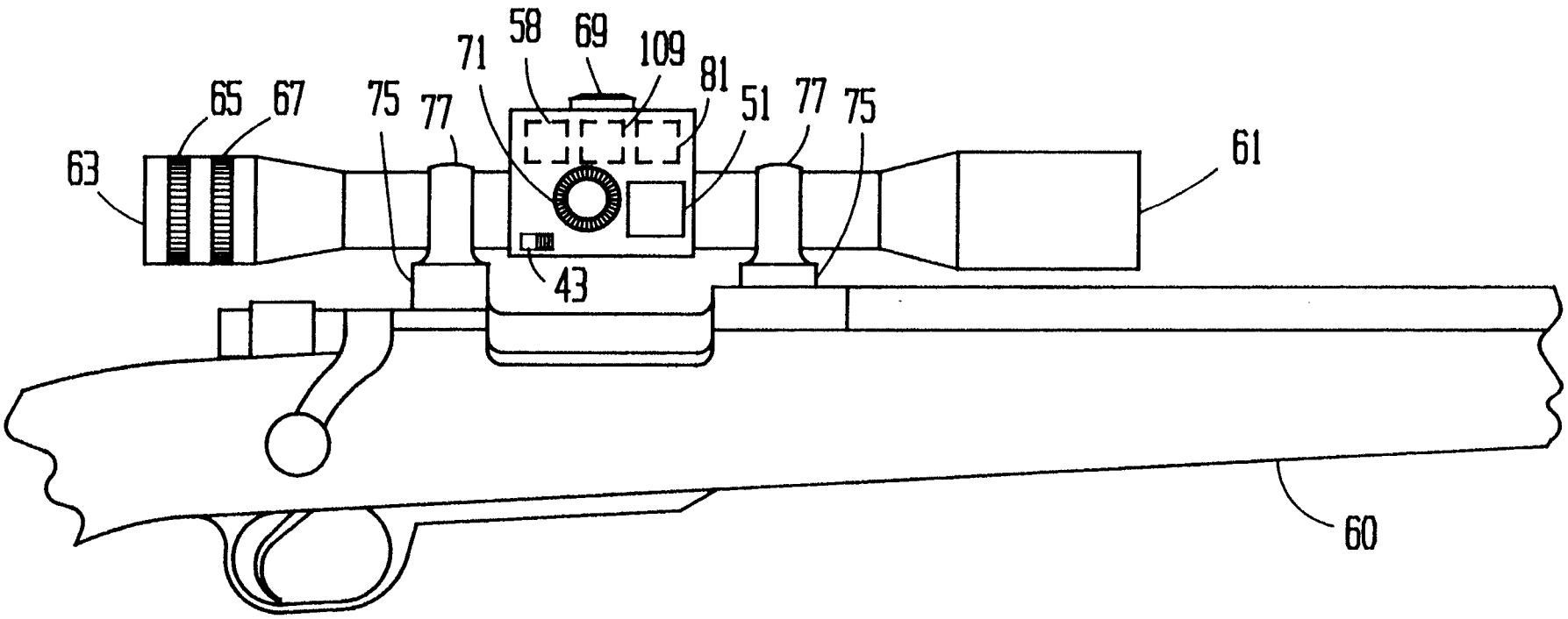
FIG. 7 is an external right side view of a preferred embodiment of that part of the species of the invention illustrated schematically in FIG. 3 that comprises the aiming mark adjustment data outputting receiver and the electric aiming mark displacement system, integrated into a variable power telescopic sight, illustrated mounted on a rifle.

FIG. 7 is an external right side view of a preferred embodiment of that part of the species of the invention illustrated schematically in FIG. 3 that comprises the aiming mark adjustment data outputting receiver 23, and the electric aiming mark displacement system 25, integrated into a telescopic sight 29 of the variable power variety, illustrated mounted on a rifle 60. The preferred embodiment illustrated in FIG. 7 is designed to be electronically slaved to the instrument illustrated in FIG. 5, and accordingly, in this preferred embodiment, the aiming mark adjustment data outputting receiver 23 is schematically illustrated as data output radio receiver 81. For ease and clarity of reference, the computer controlled, radio linked variable power scope preferred embodiment illustrated in FIG. 7 will henceforth consistently be referred to as the "computer-radio controlled VP scope".

The scope mount system for attaching the computer-radio controlled VP scope to the rifle 60, consisting of the scope bases 75 attached to the rifle 60 and the scope mounts 77 attached to the computer-radio controlled VP scope and attached to the scope bases 75, is familiar to those knowledgeable in the prior art of rifle telescopic sights, and this illustration constitutes sufficient disclosure. Features of the computer-radio controlled VP scope present in "off the shelf" manually operated, mechanical variable power telescopic sights, and thus familiar to those knowledgeable in the prior art of telescopic sights, are adequately disclosed in this illustration to those knowledgeable in the prior art of telescopic sights: the occular lense 63 through which the hunter looks into the scope, the objective lense 61 through which the image being viewed enters the scope, the scope focusing ring 65 for adjusting the scope to the user's eye, the magnification adjustment ring 67 for choosing the desired magnification (3–9X is currently the most popular magnification range for variable power scopes), the elevation adjustment screw 69 and the windage adjustment screw 71 for zeroing in the scope.

The battery compartment cover 51 covers the compartment which contains the battery, not shown, which provides the electrical power. The on-off switch 43 is utilized to activate drawing reference numerals 23 and 25. The preferred embodiment of the electric aiming mark displacement system 25 utilized in the computer-radio controlled VP scope is the electric erector tube w & e displacement system 109 which is shown schematically in the external illustration of FIG. 7. The elevation displacement subsystem of the electric erector tube w & e displacement system 109 would be as illustrated in U.S. Pat. No. 4,965,439, where elevation displacement to conform to ballistic trajectory compensation determined by a computer is applied to the erector tube by means of the spring biased elevation screw. The electric erector tube w & e displacement system 109, would, however, include not merely a computer controlled spring biased elevation screw, but also an additional computer controlled spring biased windage screw. As noted, supra, in analysis of preferred embodiments of electric aiming mark displacement system 25 illustrated schematically in FIG. 3, electric erector tube w & e displacement system 109 illustrated schematically in FIG. 7 includes a digital microprocessor with rudimentary programming to execute the displacement as per the data transmitted to data output radio receiver 81. The data output radio receiver 81, illustrated schematically, receives the outputted ballistic trajectory compensation commands transmitted by the data output transmitter 53, when the instrument illustrated in FIG. 5 is switched on and utilized, and the computer-radio controlled vp scope is also switched on.

After utilizing the instrument illustrated in FIG. 5, the hunter would raise his rifle 60, switch off the safety on the rifle, and flick the on-off switch 43 to the on position. He would shoulder the rifle 60, looking through the occular lense 63, and wait a fraction of a second for an LED dot to appear in his view, signaling that electric displacement of the aiming mark to conform with the outputted data of the instrument illustrated in FIG. 5 had been completed, and would then aim and fire, knowing that point of aim and point of impact would be congruent. Timer for electrical power and return to default setting 58 will, after a reasonable lapse of time of perhaps several minutes, automatically switch off electric power and simultaneously return the aiming mark to its zeroed in setting.

The computer-radio controlled VP scope illustrated in FIG. 7 used with the instrument illustrated in FIG. 5 combines extreme precision of ballistic trajectory compensation with great speed and ease of operation.

Figure 8:
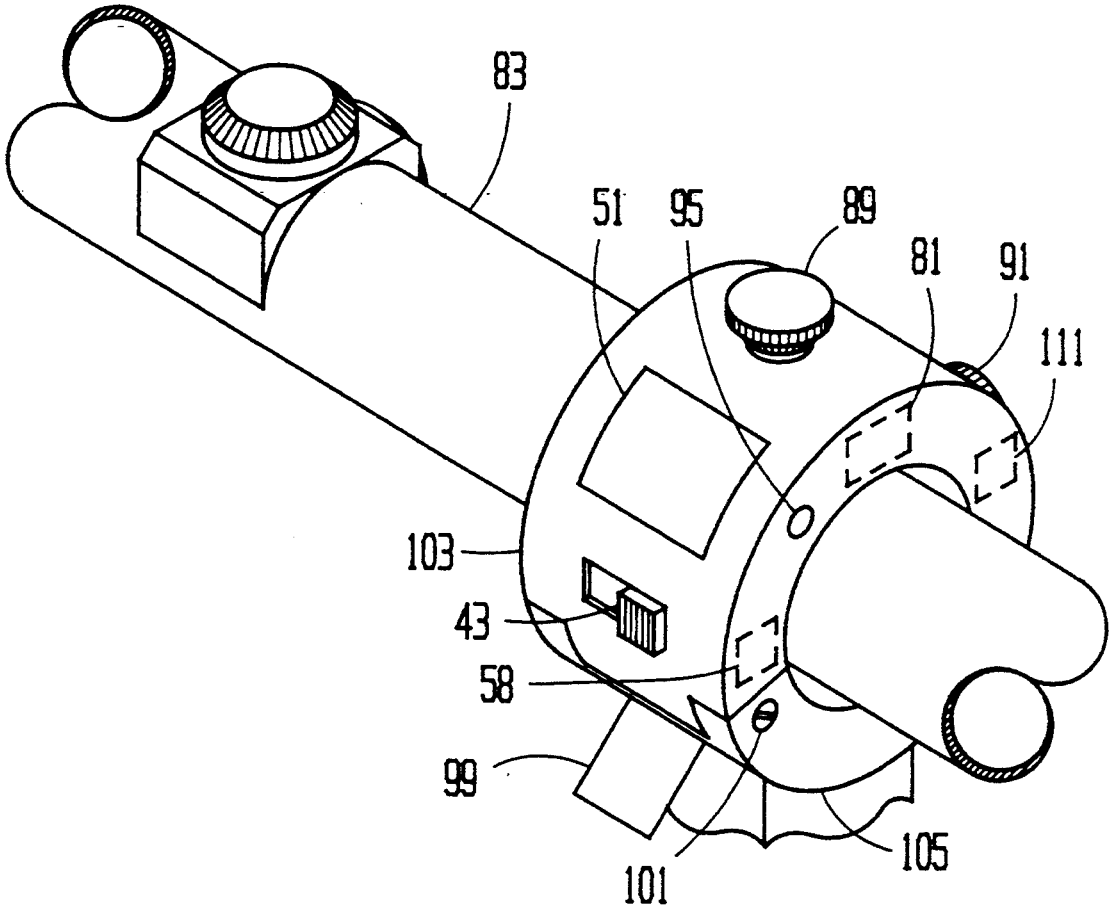
FIG. 8 is an external perspective view of a preferred embodiment of that part of the species of the invention illustrated schematically in FIG. 4 that comprises the aiming mark adjustement data outputting receiver and the electric telescopic sight displacement system integrated into an adjustable rear telescopic sight mount, illustrated together with the barrel of a conventional telescopic sight.
Figure 9:
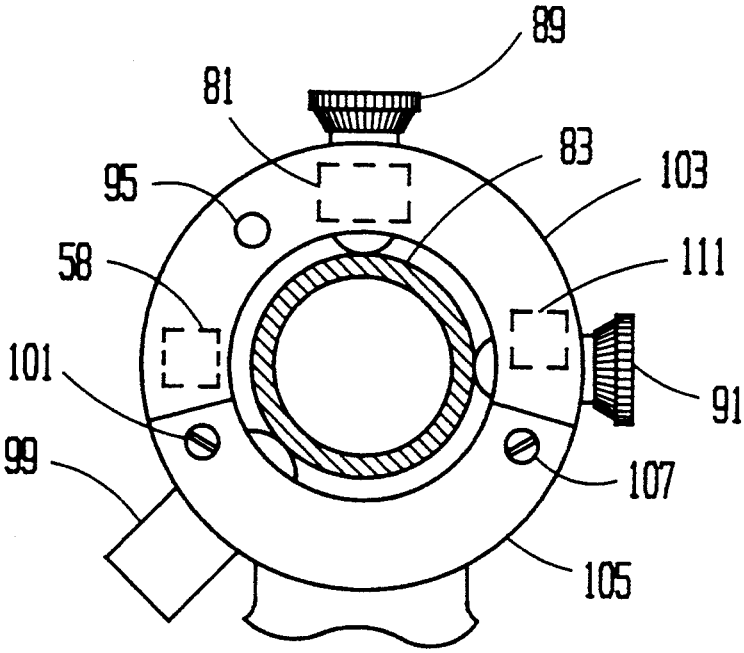
FIG. 9 is a rear external view of the preferred embodiment illustrated in FIG. 8.

FIG. 8 is an external perspective view and FIG. 9 is an external rear view of a preferred embodiment of that part of the species of the invention illustrated schematically in FIG. 4 that comprises the aiming mark adjustment data outputting receiver 23, and the electric telescopic sight displacement system 31, integrated into the adjustable telescopic sight mount 33. The scope barrel 83 is the barrel of a conventional, "off the shelf", mechanical rifle telescopic sight, either variable power or fixed, with conventional optics, and conventional built in windage and elevation adjustment controls for zeroing in the scope. This is sufficient disclosure of the conventional telescopic sight, since those knowledgeable in the prior art of rifle telescopic sights are familiar with all optical and mechanical features of such scopes.

The computer controlled, radio linked rear adjustable telescopic sight mount (henceforth, called the "computer-radio controlled scope mount"), illustrated in FIGS. 8 & 9, includes in this preferred embodiment the rear mount elevation screw 89 and the rear mount windage screw 91, with a single spring housing 99 opposing and at a 135 degree angle to both scope displacement screws. The use of the single spring for spring biasing of both displacement screws, rather than dual opposing springs as shown in U.S. Pat. No. 2,004,489, is disclosed in the adjustable scope mounts of John Unertl Optical Co. The battery compartment cover 51 is over the compartment which holds the battery, the source of electrical power for the schematically illustrated data output radio receiver 81 and the electric telescopic sight w & e displacement system 111, shown schematically in FIGS. 8 & 9. The electric telescopic sight w & e displacement system 111 is a combination of: (a) the electric computer slaved elevation screw erector tube adjustment subsystem that is disclosed in U.S. Pat. No. 4,965,439, (b) applied to both the windage and elevation screws of the adjustable telescopic sight mount disclosed in U.S. Pat. No. 2,004,489. As noted, supra, in analysis of preferred embodiments of electric telescopic sight displacement system 31, illustrated schematically in FIG. 4, electric telescopic sight w & e displacement system 111, illustrated schematically in FIGS. 8 & 9, includes a digital microprocessor with rudimentary programming to execute the displacement as per the data transmitted to the data output radio receiver 81. The on-off switch 43 is utilized to switch on the device when the instrument illustrated in FIG. 5 is transmitting outputted data. The timer for electrical power and return to default setting 58 is designed to automatically switch off electrical power and simultaneously return the rear mount elevation screw 89 and the rear mount windage screw 91 to their zero-zero settings so that the zeroed in scope adjustments of of the scope's windage and elevation adjustment controls again govern.

As is illustrated more clearly in the rear external view of FIG. 9 than in the rear perspective view of FIG. 8, the computer-radio controlled scope mount opens so that scope barrel 83 may be inserted, and then is locked in a closed position around scope barrel 83 by rear mount threaded screw fastener 101. To achieve this opening and closing around the scope barrel 83, the illustrated computer-radio controlled scope mount is divided into a rear mount top segment 103 and a rear mount bottom segment 105, which rotates to open or closed positions around rear mount bottom hinge 107, with rear mount threaded screw fastener 101 locking the illustrated computer-radio controlled scope mount securely around the scope barrel 83. No specific mount to base attachment system is illustrated in FIGS. 8 & 9, as the illustrated computer-radio controlled scope mount will use conventional "off the shelf" attachment systems.

The front mount companion to the computer-radio controlled scope mount illustrated in FIGS. 8 & 9, which front mount must allow for windage and elevation adjustment of the scope by the computer-radio controlled scope mount illustrated in FIGS. 8 & 9 while holding the scope in a fixed position on the rifle, is not illustrated as those knowledgeable in the prior art of adjustable scope mounts are familiar with the means of allowance for scope displacement by a front mount companion to an adjustable rear mount. Those knowledgeable in this prior art will be familiar with U.S. Pat. No. 4,397,107, which discloses a front mount which allows for scope movement for elevation adjustment by the rear mount while holding the scope in a fixed position on the rifle, by means of a transverse pin for fore and aft motion of the scope in the front mount. Those knowledgeable in this prior art recognize that a second identical pin in the front mount perpendicular to the rifle barrel and to the transverse pin will allow for side to side motion of the scope in the front mount while continuing to hold the scope in a fixed position on the rifle, thus allowing for windage as well as elevation adjustment by the computer-radio controlled scope mount illustrated in FIGS. 8 & 9.

After utilizing the instrument illustrated in FIG. 5, the hunter would raise his rifle, switch off the safety catch on the rifle, and flick the on-off switch 43 on the computer-radio controlled scope mount to the on position. He would wait a fraction of a second for an LED indicator 95 to light, signaling that electric displacement of the scope barrel 83 to displace the aiming mark to conform with the outputted data of the instrument illustrated in FIG. 5 had been completed, and he would then shoulder, aim, and fire, knowing that point of aim and point of bullet impact would be congruent. Timer for electrical power and return to default setting 58 would, after a reasonable lapse of time of perhaps several minutes, automatically switch off electrical power and simultaneously return the telescopic sight to its zeroed in setting.

The computer-radio controlled scope mount illustrated in FIGS. 8 & 9, used with the instrument illustrated in FIG. 5, combines precision of ballistic trajectory compensation with great speed and ease of operation, and is also cheaper than the computer-radio controlled scope.

The above description of embodiments is not to be construed as limiting the scope of the invention, but rather as exemplifying specific embodiments thereof. Numerous variations and permutations are possible. For example, included within the generic embodiment of the invention illustrated in FIG. 1 would be cordless transmission telescopic sight (and telescopic sight mount) species embodiments in which some or all the data inputting systems would be physically integrated with the scope (or the telescopic sight mount) on the rifle. Still another cordless transmission telescopic sight (and telescopic sight mount) species embodiment also included within the generic embodiment of the invention, illustrated in FIG. 1, would include, physically integrated with the scope (and telescopic sight mount), the digital microcomputer 3 and all other subsystems of the invention with the exception only of the triangulation rangefinder range data inputting system 1 and a range data outputting transmitter with a range data outputting receiver integrated with the scope (or telescopic sight mount). Another cordless transmission species embodiment would not be based on the cordless data transmission system disclosed in U.S. Pat. No, 4,754,268, in which the electric aiming mark (or telescopic sight) displacement system includes a second digital microprocessor, but would instead be based on timed radio transmission controlled by device 15; i.e., in much the same manner as children's radio control toys operate, device 15 would determine the length of time of vertical displacement radio transmission and the length of time of horizontal displacement radio transmission, which would determine the precise amount of electric aiming mark (or telescopic sight) displacement, without a second digital microprocessor being required in the electric aiming mark (or telescopic sight) displacement system. Although preferred embodiments of the invention have been illustrated in which the computer outputs data for adjusting windage as well as elevation, the invention would include embodiments in which the computer only outputted data for elevation adjustment. Accordingly, the scope of the invention should be determined not by the embodiments presented, but by the appended claims and their legal equivalents.

What is claimed is:

1. A digital microcomputer for ballistic trajectory compensation of a small arms aiming mark, comprising:

(a) triangulation rangefinder range data inputting means;

(b) digital microcomputer means;

(c) program means;

(d) small arms ballistic trajectory program means in the program means;

(e) means for inputting data for a plurality of small arms ammo;

(f) other data inputting means;

(g) means for cordless transmission of data;

(h) means for reception of cordless transmission of data;

(i) electric aiming mark displacement means for executing aiming mark displacement as per data outputted by the digital microcomputer means;

(j) the triangulation rangefinder range data inputting means and means for cordless transmission of data are both physically separate from and physically unconnected to both the electric aiming mark displacement means and means for reception of cordless transmission of data, outputted by the digital microcomputer means.

2. A microcomputer according to claim 1 wherein said electric aiming mark displacement means comprises:

(a) telescopic sight means containing the means for reception of cordless transmission of data;

(b) electric telescopic sight aiming mark displacement means in the telescopic sight means for executing aiming mark displacement as per aiming mark displacement data outputted by the digital microcomputer means.

3. A microcomputer according to claim 1 wherein said electric aiming mark displacement means comprises:

(a) adjustable external telescopic sight mount means containing the means for reception of cordless transmission of data;

(b) electromechanical telescopic sight displacement means in the adjustable mount means for executing telescopic sight displacement as per data.

* * * * *

UNITED STATES PATENT AND TRADEMARK OFFICE

CERTIFICATE OF CORRECTION

PATENT NO. : 5,375,072

DATED : December 20, 1994

INVENTOR(S) : Stephen B. Cohen

It is certified that error appears in the above-indentified patent and that said Letters Patent is hereby corrected as shown below:

Col. 26, lines 47-48, delete ", outputted by the digital microcomputer means".
Col. 26, line 67, add at the end before the period, --outputted by the digital microcomputer means--.
IN THE ABSTRACT:
Line 6, delete "(9)".

Col. 3, line 9, delete ":".
Col. 6, lines 11 and 16, change "Bart" to --Barr--.
Col. 6, line 16, change "," to --.--.
Col. 7, line 2, change "-" to ------.
Col. 18, line 30, change "with" to --with)--.
Col. 19, line 15, change "wails" to--waits--.
Col. 20, line 11, delete ",".
Col. 20, line 23, delete ":".
Col. 21, line 54, after "determined", add --by--.

Signed and Sealed this

Twenty-eight Day of February, 1995

Bruce Lehman

*Attest:*

BRUCE LEHMAN

*Attesting Officer*

*Commissioner of Patents and Trademarks*